US007533829B2

(12) United States Patent
Osler et al.

(10) Patent No.: US 7,533,829 B2
(45) Date of Patent: May 19, 2009

(54) RAIL-MOUNTING ASSEMBLY

(76) Inventors: Wilbur F. Osler, 13355 Main Rd., Mattituck, NY (US) 11952; Scott D. Osler, 13355 Main Rd., Mattituck, NY (US) 11952

( * ) Notice: Subject to any disclaimer, the term of this patent is extended or adjusted under 35 U.S.C. 154(b) by 490 days.

(21) Appl. No.: 11/363,445

(22) Filed: Feb. 27, 2006

(65) Prior Publication Data

US 2006/0196962 A1 Sep. 7, 2006

Related U.S. Application Data

(60) Provisional application No. 60/656,217, filed on Feb. 25, 2005.

(51) Int. Cl.
*E01B 9/00* (2006.01)

(52) U.S. Cl. ..... 238/264; 238/283; 238/382

(58) Field of Classification Search ..... 238/264, 238/269, 280, 283, 287, 306, 307, 349, 351, 238/382, 308, 279, 271
See application file for complete search history.

(56) References Cited

U.S. PATENT DOCUMENTS 6,761,322 B1 * 7/2004 Porrill et al. ..... 238/264
6,789,740 B2 * 9/2004 Osler ..... 238/264

* cited by examiner

*Primary Examiner*—Mark T Le
(74) *Attorney, Agent, or Firm*—Andrew Wilford

(57) ABSTRACT

A rail-mounting assembly has a generally rectangular base frame formed with a window and having a pair of diagonally opposite abutments at respective ends of the window and having downwardly and inwardly inclined faces. A top plate in the window has a lower face above a lower face of the frame, a pair of bosses projecting upward from the top plate and each juxtaposed with a respective one of the abutments and each having a downwardly and inwardly inclined face spacedly juxtaposed with the downwardly and inwardly inclined face of the respective abutment. A one-piece elastomeric body is bonded to and interposed between the inclined faces of the frame and of the top plate.

14 Claims, 7 Drawing Sheets

RAIL-MOUNTING ASSEMBLY

CROSS REFERENCE TO RELATED APPLICATION

This application is related to provisional application 60/656,217 filed 25 Feb. 2005.

FIELD OF THE INVENTION

The present invention relates to a rail-mounting assembly of the type in which a metal top plate is received in a base frame that is attached to a sleeper or rail bed and a cushion of elastomer bonded to both the top plate and the base frame is provided between the juxtaposed faces of the two parts.

BACKGROUND OF THE INVENTION

Successful rail mounting assemblies are disclosed in U.S. Pat. No. 6,789,740 and to U.S. patent application Ser. No. 10/691,454 (now U.S. Pat. No. 6,986,470). In these rail mounting assemblies which can be referred to as "egg" designs, the frame has a generally elongated or oval opening formed at its ends with inclined faces and four lugs symmetrically disposed at opposite ends of the frame to receive bolts for attachment of the base plate to the support structure.

The top plate is also symmetrical about the longitudinal axis and has at its ends inclined faces juxtaposed with the inclined faces of the frame and bonded, e.g. by vulcanization, to an elastomer body received between the juxtaposed faces and extending around the sides of the top plate and the frame. Such track fasteners are particularly useful for vibration-sensitive locations.

OBJECT OF THE INVENTION

The principal object of the present invention is to provide an improved system-wide track fastener or rail-mounting assembly that has some of the advantages of the designs described in the two cited publications and to make the rail-mounting assembly more universally applicable and acceptable.

Another object is to provide a track fastener that is an improvement over traditional two-bolt fasteners currently available for systemwide application.

SUMMARY OF THE INVENTION

These objects and others that will become apparent hereinafter are attained, in accordance with the invention with an asymmetrical structure in which the base plate is formed at two diagonally opposite corners with beveled or truncated regions having elongated holes for receiving the bolts, the other corners of the otherwise rectangular or substantially rectangular base plate being formed with right angles. According to the invention, instead of having the inclined end faces on abutments extending arcuately substantially all across the opening in the frame, as in U.S. Pat. No. 6,789,740 and U.S. Pat. No. 6,986,470, the asymmetrical rail-mounting assembly of the invention has a pair of mutually parallel and linearly extending abutments that form the inclined faces and are disposed adjacent the beveled sections, respectively.

Similarly, the top plate is asymmetrical in the sense that the eyes or bosses formed thereon to straddle the rail that rests upon the rectangular plate portion between these bosses, are diagonally opposite one another instead of being located along the axis of symmetry as in U.S. Pat. No. 6,789,740 and U.S. Pat. No. 6,986,470. These bosses are contiguous with formations provided with the inclined faces juxtaposed with the end faces of the base plate and are bonded to an elastomeric layer that fills the space between the juxtaposed faces and between the sides of the top plate and the sides of the frame. We have found that the preferred angle between the vertical and these faces should be 42°+25° and more preferably 42°+10°. Best results are obtained when the angle is 42°+5° with the very best results at 42°+2°. The 42° angle is optimum to maximize lateral v. vertical stiffness. Other angles can lower the ratio of lateral to vertical stiffness.

The elastomeric material of the body can be molded over the aforementioned abutments so as to extended between the juxtaposed faces and then over and around the sides and back of each abutment.

According to a feature of the invention, the elastomeric body also extends from the gap between the parallel sides of the top plate and frame over the frame sides and onto the outer faces of the frame sides. The top of the frame sides and the top of the abutments over which the elastomeric body is formed can be rounded.

According to another feature of the invention, the elastomeric body forms a number of pads on the underside of the top plate and between the top plate and any supporting face on which the rail-mounting assembly is anchored. These pads, for example, can include two triangular pads in the regions of the beveled areas receiving the bolts and two rectangular pads each underlying a respective boss and the raised formation provided with the inclined face of the top plate.

BRIEF DESCRIPTION OF THE DRAWING

The above and other objects, features, and advantages will become more readily apparent from the following description, reference being made to the accompanying drawing in which.

SPECIFIC DESCRIPTION

Figure 8:
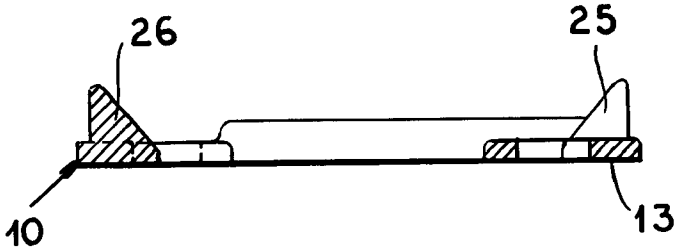
FIG. 8 is a longitudinal section taken along line VIII-VIII of FIG. 7.
Figure 7:
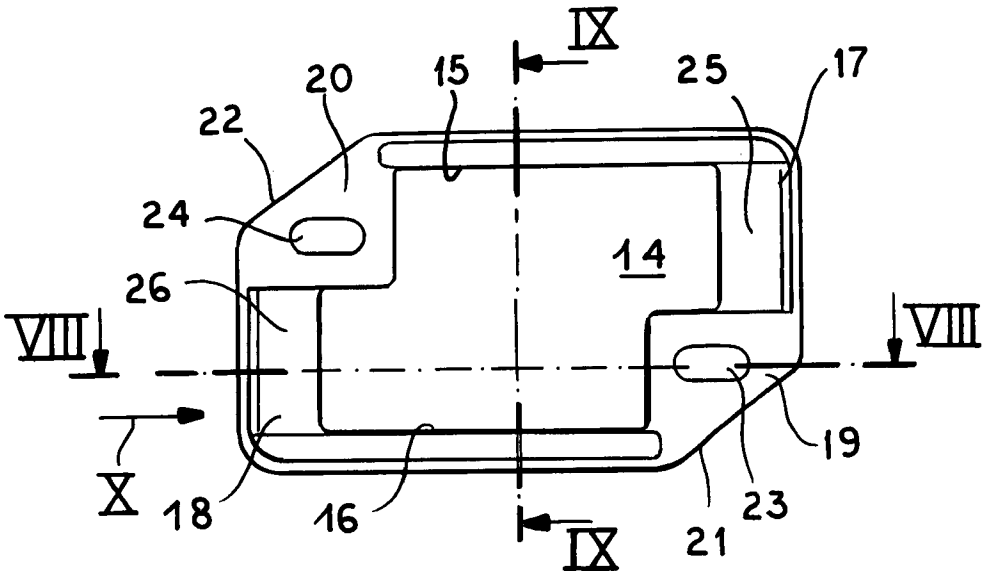
FIG. 7 is a top plan view of the base frame.
Figure 14:
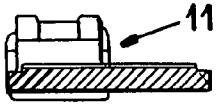
FIG. 14 is a cross section taken along line XIV-XIV of FIG. 11.
Figure 15:
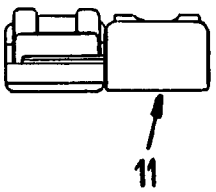
FIG. 15 is an end view taken in the direction of arrow XV of FIG. 11.
Figure 16:
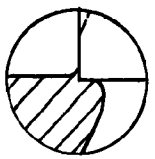
FIG. 16 is the detail shown at XVI in FIG. 13.
Figure 13:
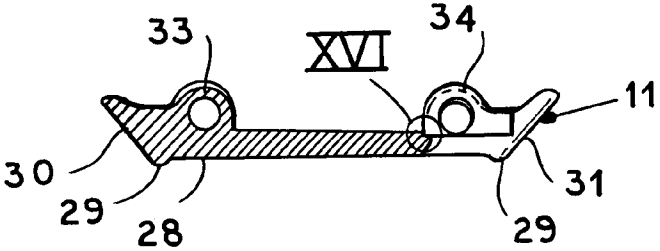
FIG. 13 is a longitudinal section taken along line XIII-XIII of FIG. 11.

The essential elements of the rail-mounting assembly shown in the drawing are a cast-metal base frame 10, a cast-metal top plate 11 and a one-piece body 12 of elastomeric material bonded to confronting faces of the top plate 11 and the base frame 10. As can be seen from FIGS. 3 and 7 to 10, the base plate 10 has a planar lower face 13 and is of generally rectangular configuration surrounding a generally Z-shaped window 14 extending vertically through the bottom plate 13 and delimited between upstanding side ribs 15 and 16 that are parallel to one another and flank the opening. At the ends of the frame 10, the window 14 is bounded by two upstanding abutment ribs 17 and 18 adjoining truncated corners 19 and 20 defined by bevel edges 21 and 22 and provided with respective slots 23 and 24 through which bolts can be inserted to hold the assembly on a support, e.g. a sleeper, indicated schematically at S in FIG. 3. The abutment ribs 17 and 18 have downwardly and inwardly inclined flat faces 25 and 26 (FIG. 8) inclined to the vertical at a preferred angle of 42° but that can be at any angle ranging between 42°+25° as has been noted.

Figure 12:
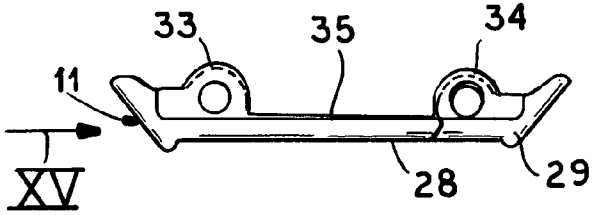
FIG. 12 is a side view taken in the direction of arrow XII of FIG. 11.
Figure 11:
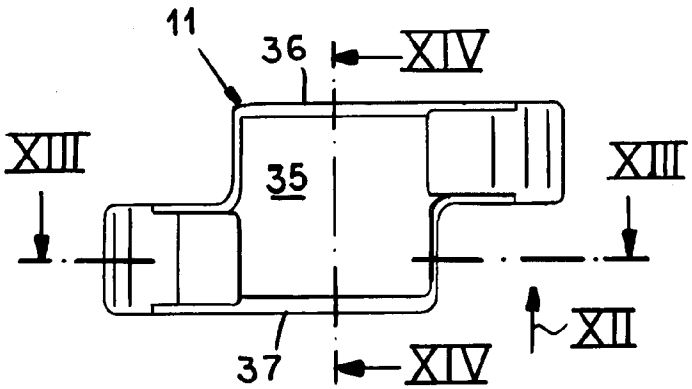
FIG. 11 is a top plan view of the top plate all alone.
Figure 22:
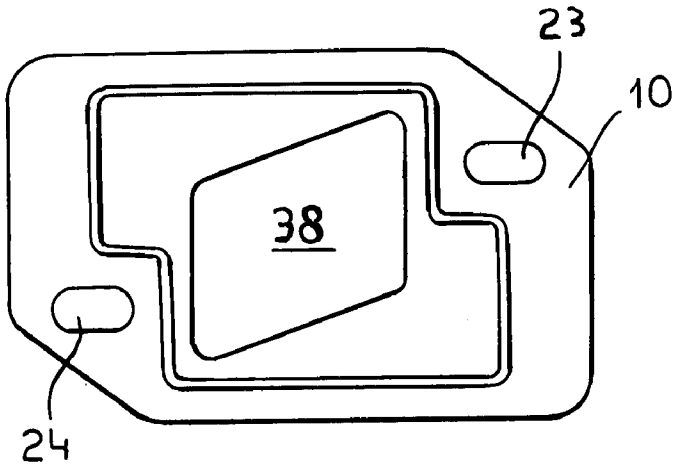
FIG. 22 is a bottom view of the assembly.
Figure 17:
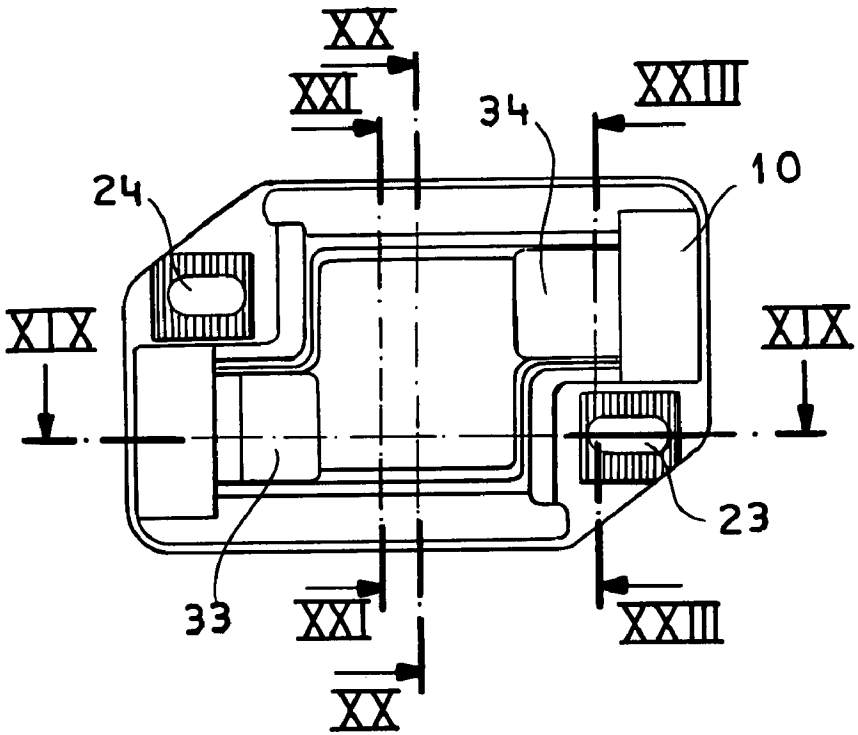
FIG. 17 is a top plan view of another embodiment of the rail mount of this invention.
Figure 23:
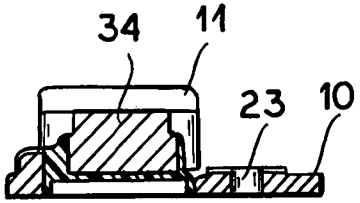
FIG. 23 is a cross section taken along line XXIII-XXIII of FIG. 17.
Figure 20:
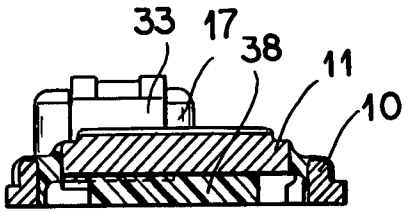
FIGS. 20 and 21 are cross sections taken along respective lines XX-XX and XXI-XXI of FIG. 17.
Figure 21:
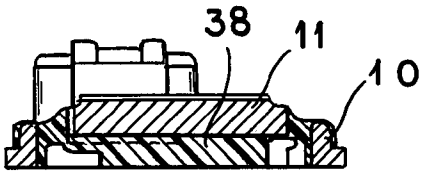
Figure 19:
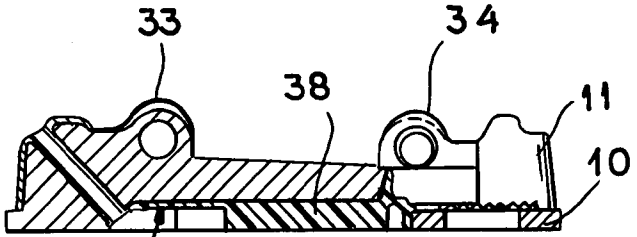
FIG. 19 is a longitudinal section taken along line XIX-XIX of FIG. 17.
Figure 18:
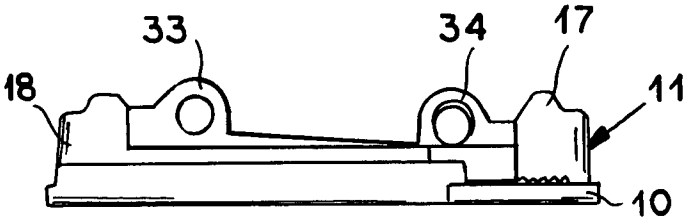
FIG. 18 is a side view taken in the direction of arrow XVIII of FIG. 17.

As can be seen best from FIGS. 11 to 16, the top plate 11 can also have a Z-shaped outline complementarily fitting in the opening or window 14 and has a mainly planar lower face 28 having at its ends crosswise and downwardly projecting ridges 29. The top plate 11 has downwardly and inwardly inclined faces 30 and 31 that can confront and extend to the faces 26 and 25 when the parts 10 and 11 are slightly spaced. These faces are also inclined at 42°+25° but of course have the same angle as the faces 25 and 26. Inwardly of these faces 30 and 31, the top plate 11 is provided with two semicylindrical bosses or lugs 33 and 34 that can be tubular to accommodate track hold-down fasteners engageable with the respective outer flanges of a track rail shown partially in FIG. 3 at R and sitting on an upper face 35 of the part 11. This face 35 may be inclined as shown in FIG. 12 but can be parallel to the lower face 28 if desired.

Figure 4:
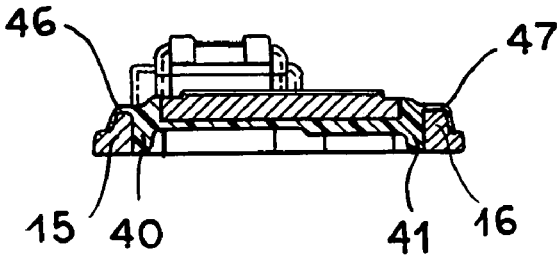
FIGS. 4 and 5 are cross sections taken along respective line IV-IV and V-V of FIG. 2.
Figure 5:
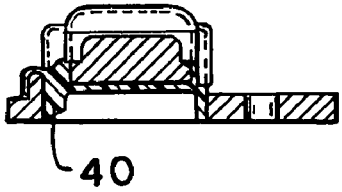
Figure 9:
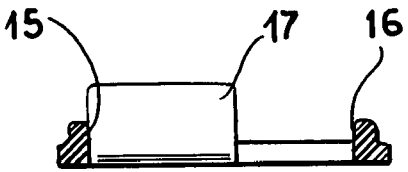
FIG. 9 is a cross section taken along line IX-IX of FIG. 7.
Figure 10:
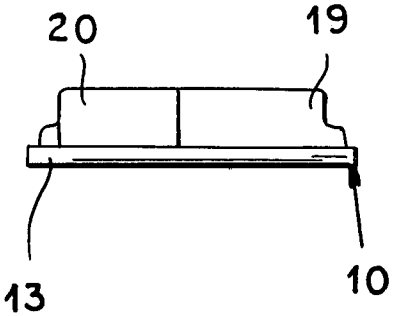
FIG. 10 is an end view taken in the direction of arrow X of FIG. 7.

As is also apparent from FIGS. 11 to 16, the top plate 11 has side edges 36 and 37 that can be juxtaposed with the ribs 15 and 16 when the top plate 11 is inserted in the frame 10. When the top plate 11 is inserted into the frame 10, the body 12 of elastomeric material is molded between the frame 10 and the top plate 11 in one piece so that the elastomer, for example, is bonded at 39 between the juxtaposed faces 26 and 30 and in addition is bonded between the side walls of the frame and the sides of the top plate 11 as shown at 40 and 41 (FIG. 4). The lower face 28 of the top plate 10 is above the plane of the lower face 13 of the frame 10 and the body 12 forms pads 42, 43, 44 and 45 in the downwardly open cavity or recess formed there, which cavity is closed by the support S. The larger pads 42 and 43 that are diagonally opposite one another in the window 14 and that adjoin the abutments 25 and 26 of the base frame 10 are of rectangular outline while the smaller pads 44 and 45 in the other two diagonally opposite corners of the window 14 are of triangular outline. The lower faces of these pads 42, 43, 44, and 45 are all coplanar with one another and with the lower face 13 of the frame 10.

Figure 1:
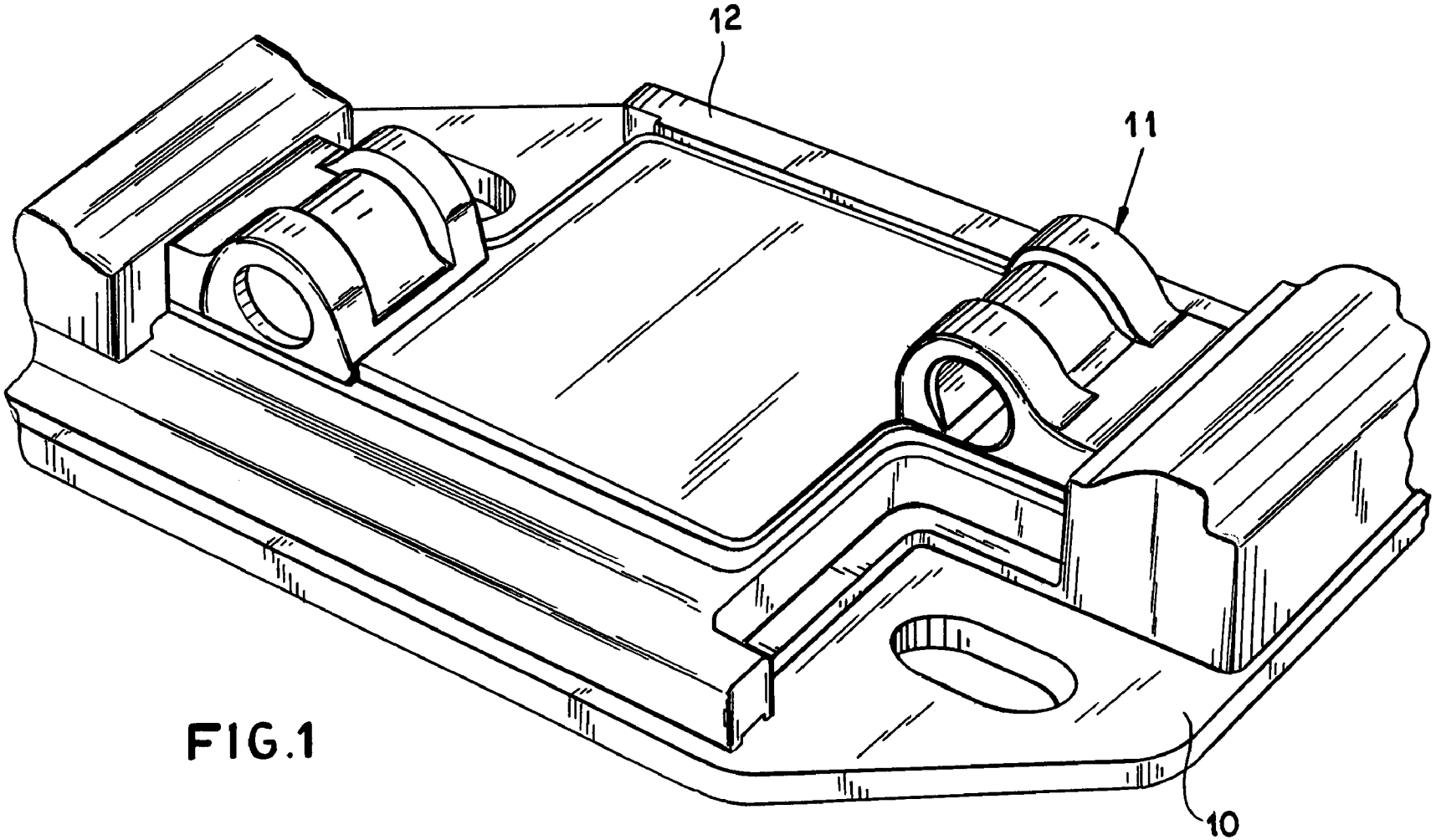
FIG. 1 is a perspective view of the complete rail-mounting assembly according to the invention.
Figure 6:
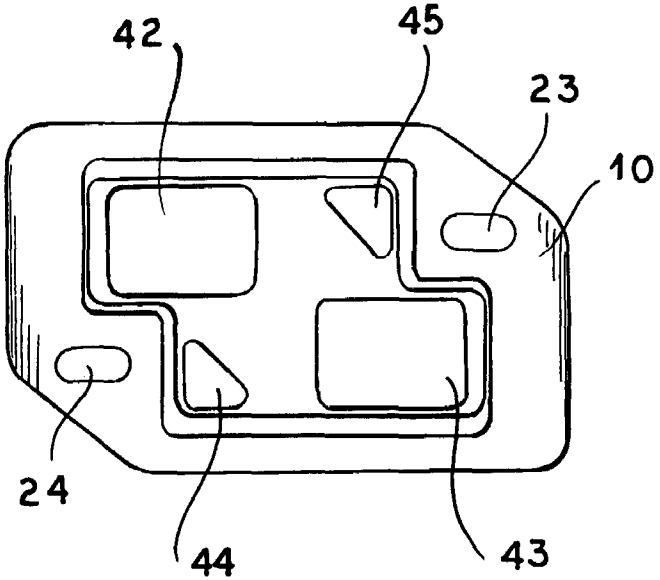
FIG. 6 is a bottom view of the assembly.
Figure 2:
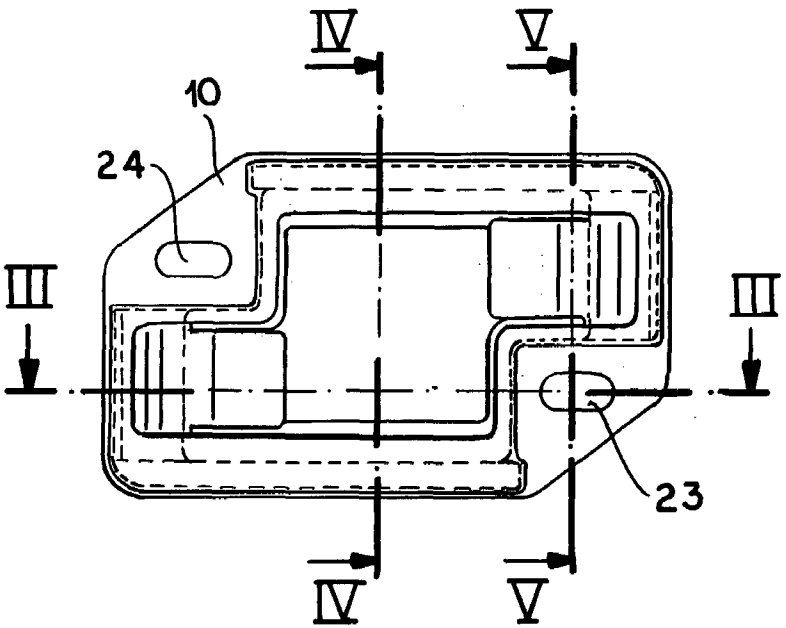
FIG. 2 is a plan view of the rail-mounting assembly.
Figure 3:
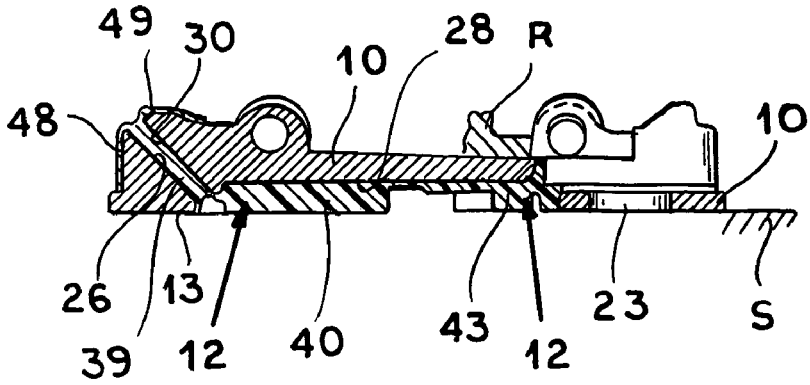
FIG. 3 is a longitudinal section taken along line III-III of FIG. 2.

As can be seen from FIG. 4, the elastomer is turned over the rounded ribs 15 and 16 at 46 and 47. The elastomer is also continued over the abutment at 48 as shown in FIG. 3 and over the rounded upper edge of the inclined portion of the top plate 11 at 49. The assembly shown in the drawing is used in the same manner as the assembly of above-cited U.S. Pat. No. 6,789,740 and U.S. Pat. No. 6,986,470 and the elastomer used can be any of the elastomers mentioned therein.

FIGS. 17 through 23 show another embodiment that is essentially identical to that described above, except that, instead of four pads 42, 43, 44, and 45, there is a single parallelogrammatic pad 38 oriented with its short parallel sides extending perpendicular and crosswise of the assembly and its long parallel sides extending at acute angles to the longitudinal axis of the assembly, which itself extends horizontal and perpendicular to the rail R this assembly serves to hold down on the support S. Like the pads 42, 43, 44, and 45, the pad 38 is received with all-around space in the window 14, that is does not normally horizontally engage the inner edges of the window opening 14.

Unlike the system of the aforementioned patent, with the 42° angle of the load-transferring faces, the load is transferred in both shear and compression. The system requires only two anchor bolts, thereby simplifying the use of the device. The inclined faces increase lateral stiffness in a way that has not been obtainable with earlier two bolt designs.

The side walls of the top plate can be completely surrounded with the elastomer, thereby buffering all forces transmitted by the top plate. The elastomer prevents extreme forces from reaching the frame and hence the anchor bolts, thereby eliminating anchor bolt failure and deterioration of the female inserts into which the anchor bolts are engaged. The frame acts as a containment completely surrounding the periphery of the top plate thereby providing positive lateral and longitudinal restraint i.e. a fail-safe restraining that is effective even in the event of failure of the elastomer or its bond to the metal.

The lowest point of containment of the face 35 is above the elastomer connecting the top plate 11 to the frame 10, thereby protecting the elastomer against wear. A change in the elastomer durometer or number of pads, pad sizes, pad locations, pad configurations, pad depth or any combination of these on the underside of the top plate allows vertical stiffness to be altered. The invention permits additional pads to come into play as deflection increases, thereby making possible a track fastener with dual or even triple vertical spring stiffness. While the angles of inclination of the faces 26, 30 and 25, 31 can be the same and most preferably 42° as noted, if special stiffness characteristics are desired, the angles of both end inclined faces can be varied for example through a range of 15° to 75° unequally so that the angle at one end could be say 45° and the angle at the other end 30°.

The side walls and lower face of the top plate can be covered totally or partially by the elastomer to buffer all forces transmitted from the top plate and thereby buffering or reducing the forces that are transmitted to the anchor bolts, thereby reducing bolt failure and the failure of anchor inserts in the concrete. The frame, as in the egg design, completely surrounds the periphery of the top plate providing positive lateral and longitudinal restraint.

We claim:

1. A rail-mounting assembly comprising:

a generally rectangular base frame with one pair of corners truncated at respective bevels and provided with openings enabling the frame to be affixed on a support, the frame being formed with a window bounded by a pair of parallel sides of the base frame, the frame having a pair of diagonally opposite abutments each disposed adjacent a respective one of the truncated corners and at a respective end of the window, the abutments having downwardly and inwardly inclined faces;

a top plate received in the window and having a lower face above a lower face of the frame, a pair of bosses projecting upward from the top plate and each juxtaposed with a respective one of the abutments and each having a downwardly and inwardly inclined face spacedly juxtaposed with a respective one of the downwardly and inwardly inclined faces of the respective abutment; and a one-piece body of an elastomeric material bonded to and interposed between the inclined faces of the frame and of the top plate, the body extending down into the window and forming at least one downwardly projecting pad in the window and between the lower face of the frame and the lower face of the top plate.

2. The rail-mounting assembly defined in claim 1 wherein the downwardly and inwardly inclined faces include an angle of 42°±25° with the vertical.

3. The rail-mounting assembly defined in claim 2 wherein the elastomeric body extends unitarily over the sides of the frame.

4. The rail-mounting assembly defined in claim 2 wherein the elastomeric body extends unitarily over the abutments.

5. The rail-mounting assembly defined in claim 2 wherein the elastomeric body extends over a respective end of the top plate.

6. The rail-mounting assembly defined in claim 1 wherein the pad is received with all-around space in the window.

7. The rail-mounting assembly defined in claim 1 wherein the pad has a lower face substantially coplanar with the lower face of the frame.

8. The rail-mounting assembly defined in claim 1 wherein the elastomeric body forms a plurality of downwardly projecting pads in the window.

9. The rail-mounting assembly defined in claim 8 wherein the pads are circular, oval, rectangular or triangular.

10. The rail-mounting assembly defined in claim 1 wherein the elastomeric body forms a single pad of polygonal outline received all-around space in the window and having a lower pad face substantially coplanar with the lower face of the frame.

11. The rail-mounting assembly defined in claim 10 wherein the pad is generally parallelogrammatic.

12. The rail-mounting assembly defined in claim 2 wherein the angle is 42°±10°.

13. The rail-mounting assembly defined in claim 2 wherein the angle is 42°±5°.

14. The rail-mounting assembly defined in claim 2 wherein the angle is 42°±2°.

* * * * *